United States Patent [19]

Paparella

[11] 4,234,774

[45] Nov. 18, 1980

[54] IMITATION WALL SWITCH

[75] Inventor: James B. Paparella, Andover, Mass.

[73] Assignee: American Publishing Corporation, Watertown, Mass.

[21] Appl. No.: 22,214

[22] Filed: Mar. 19, 1979

[51] Int. Cl.[2] ..... H01H 3/20

[52] U.S. Cl. ..... 200/330; 200/333

[58] Field of Search ..... 200/330, 331, 333; 174/66

[56] References Cited

U.S. PATENT DOCUMENTS

| | | | |
|---|---|---|---|
| 2,211,818 | 8/1940 | Innis | 200/331 |
| 2,211,819 | 8/1940 | Innis | 200/331 |
| 2,285,561 | 6/1942 | Botuck | 200/330 |
| 2,382,738 | 8/1945 | Moyses | 200/330 |
| 2,712,582 | 7/1955 | Peretti | 200/330 |
| 3,121,778 | 2/1964 | Sander et al. | 200/331 |
| 3,892,935 | 7/1975 | Patterson | 200/331 |
| 4,105,884 | 8/1978 | Damsky | 200/331 |

*Primary Examiner*—Stephen Marcus

*Attorney, Agent, or Firm*—Robert T. Gammons

[57] ABSTRACT

An imitation wall switch adapted to be placed over an existing wall switch and operably connected to the latter, said imitation wall switch including an imitation wall plate of large area for receiving a distinctive color and/or legends and a correspondingly large imitation switch lever.

6 Claims, 14 Drawing Figures

IMITATION WALL SWITCH

BACKGROUND OF THE INVENTION

The conventional wall switch is provided with a wall plate which is of relatively small area and although such wall plates are sometimes decorated with embossments or art work, they remain somewhat inconspicuous and difficult to locate if the room is dimly lighted and afford little opportunity for novelty effects such as would appeal to a child or would contribute to the decor of a play room or family room. It is the purpose of this invention to provide an imitation wall switch of abnormal size so as to attract attention and to provide a broad surface for receiving vivid colors and/or legends and which can be installed without altering the existing electrical connections.

SUMMARY OF THE INVENTION

An imitation wall switch of large size for use in conjunction with an existing wall switch of the kind wherein there is a wall plate attached to a wall receptacle through which projects one end of a toggle lever comprising an imitation wall plate of larger size than the conventional wall plate containing a centrally-located opening, a correspondingly large imitation switch lever pivotally mounted in the opening with one end protruding through the face of the imitation wall plate and the other end protruding from the back of the imitation wall plate, and means for attaching the imitation wall plate to the existing wall plate with the inwardly-protruding end of the switch lever in operative engagement with the one end of the toggle lever so that manipulation of the switch lever effects actuation of the toggle lever. The inwardly-projecting end of the switch lever is coupled to the toggle lever with a yieldable coupling comprising a flexible link, one end of which is pressed onto the end of the toggle lever and the other end of which is received within an opening in the inner end of the switch lever. The switch lever is pivotally supported in the opening by arcuate bearings arranged with their convex sides engaged with the inner side of the imitation wall plate and the means for securing the imitation wall plate comprises an adapter plate adapted to be screwed together with the existing wall plate to the wall receptacle. The imitation wall plate has peripherally thereof a continuous flange which is perpendicular to the plane of the plate which defines with the plate an enclosure which conceals the existing wall plate, the adapter plate, the inwardly-projecting end of the switch lever and the coupling.

The invention will now be described in greater detail with reference to the accompanying drawings, wherein.

Figure 9:
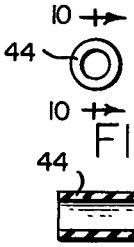
FIG. 9 is an elevation at one end of the flexible coupling.
Figure 10:
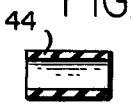
FIG. 10 is a section taken on the line 10—10 of FIG. 9.
Figure 11:
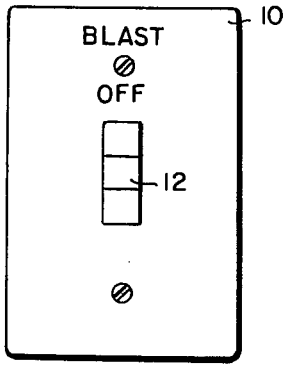
FIGS. 11, 12 and 13 show front elevational views of imitation wall plates bearing distinctive legends.
Figure 12:
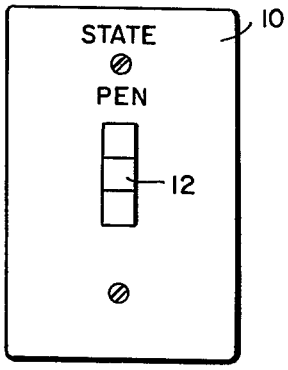
Figure 13:
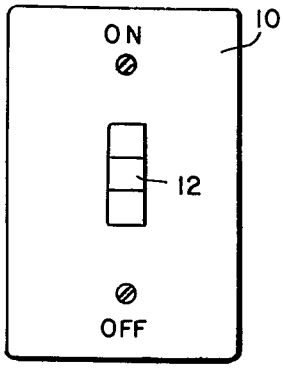

Referring to the drawings, the imitation wall switch comprises an imitation wall plate 10 of large size which is mounted over the existing wall switch and an imitation switch lever 12 is coupled to the existing toggle lever in such a way that manipulation of the imitation switch lever 12 will effect a corresponding manipulation of the existing toggle lever. As illustrated, the imitation wall plate is at least twice the size of the existing wall plate and presents a broad surface which may be painted a bright color and/or provided with distinctive legends such, for example, as shown in FIGS. 9, 10 and 11 to attract attention not only to make it easily visible in a dimly lighted room for a person with poor eyesight, but also affords a novelty effect for playrooms, children's rooms and the like.

Figure 14:
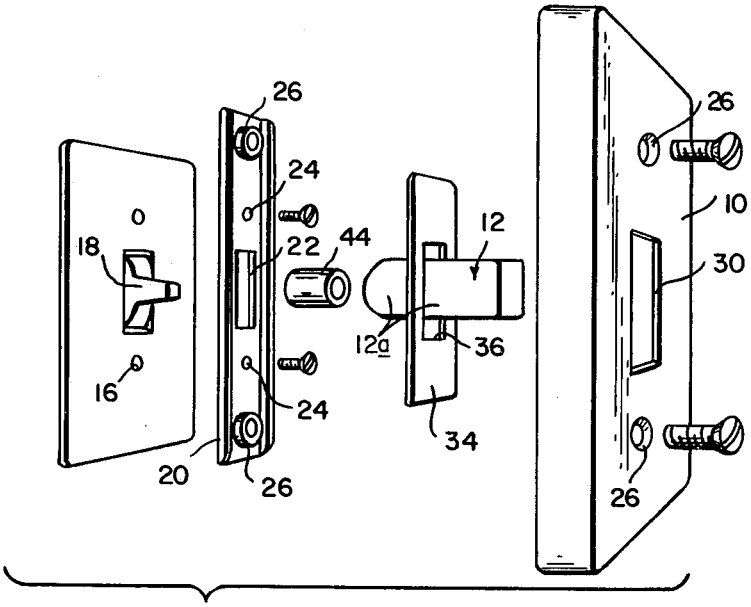
FIG. 14 is an exploded view of the imitation wall switch.
Figure 2:
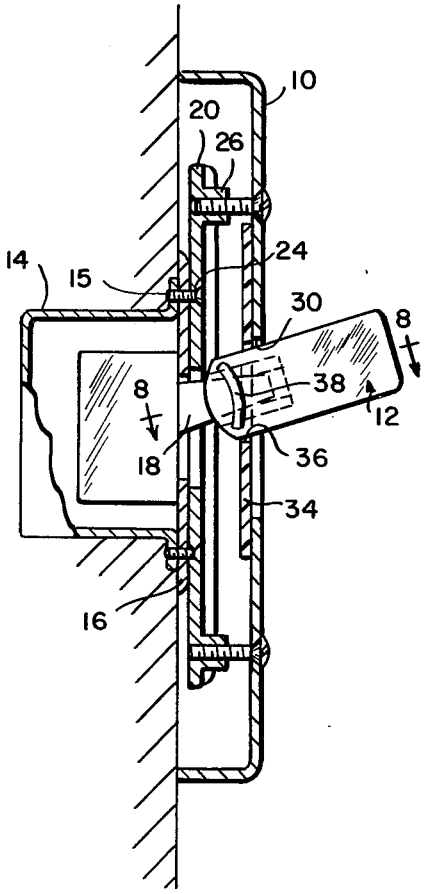
FIG. 2 is a section taken on the line 2—2 of FIG. 1 showing attachment of the imitation switch lever to the wall over an existing wall plate and switch.
Figure 1:
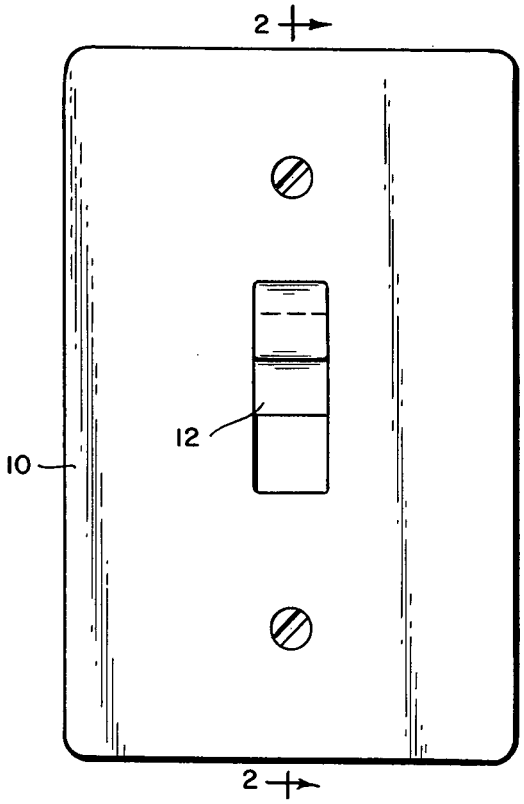
FIG. 1 is a front elevation of the imitiation switch.

Referring specifically to FIG. 2, there is shown in section an existing wall receptacle 14 provided at its opened front side with threaded openings 15—15 for receiving screws to attach the wall plate 16. The imitation wall plate 10 of the imitation wall switch of this invention is designed to be placed over the existing wall plate 16 and to be attached thereto and to support the imitation switch lever 12 in operative relation to the existing toggle switch 18.

Figure 3:
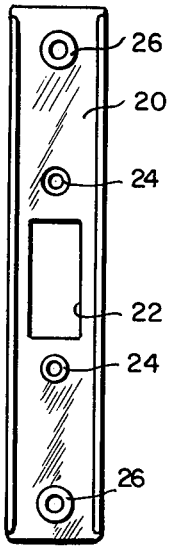
FIG. 3 is an elevation of an adapter plate for attaching the imitation wall plate to the existing wall plate.
Figure 4:
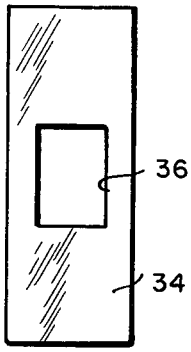
FIG. 4 is a mounting plate for the imitation switch lever.

For mounting the imitation wall plate 10, there is provided an adapter plate 20, FIG. 3, containing a rectangular opening 22 located substantially midway between its opposite ends and two pairs of openings 24—24 and 26—26. The openings 24—24 are spaced so as to be aligned with the openings 15—15 in the existing wall receptacle so that the adapter plate can be attached to the existing wall plate with the same screws that are used to attach the existing wall plate to the wall receptacle. The imitation wall plate 10 is provided with a central rectangular opening 30 and a pair of openings 32—32 which are spaced apart so as to be aligned with the pair of openings 26—26 in the adapter plate and screws are provided for screwing the imitation wall plate to the adapter over the existing wall plate.

Figure 8:
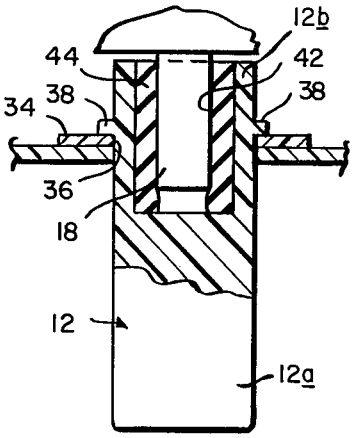
FIG. 8 is a view taken on the line 8—8 of FIG. 2.
Figure 5:
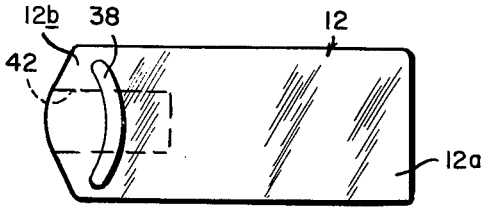
FIG. 5 is a side elevation of the imitation switch lever.
Figure 7:
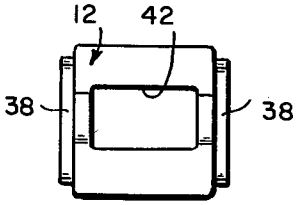
FIG. 7 is an end view as seen from the left side of FIG. 5.
Figure 6:
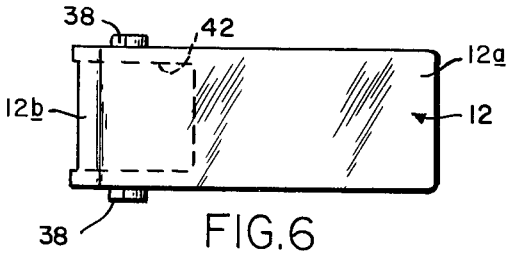
FIG. 6 is a top view of the imitation switch lever.

The imitation switch lever 12, FIGS. 5 to 7, is of rectangular cross section and is mounted within the opening 30 with one end 12*a* protruding from the outer side of the imitation wall plate and the other end 12*b* protruding from the inner side of the imitation wall plate in alignment with the protruding end of the existing toggle switch 18. A bearing plate 34 containing an opening 36 corresponding in cross section to the cross section of the imitation switch lever 12 is mounted over the switch lever at the inner side of the imitation wall plate and provides at the inner side a rocker surface upon which rocks a pair of transversely-spaced arcuate bearing elements 38—38 which are held against the bearing plate 34 by an elastically yieldable coupling 44, FIG. 8, mounted between the inner end 12*b* of the switch lever 12 and the toggle lever 18 so that the switch lever 12 is pivotally supported to the imitation wall plate. The inner end 12*a* of the the switch lever 12 contains an opening 42, FIG. 7, and the yieldable coupling 44, which is a short length of rubber tube, FIG. 8, mounted between the inner end of the switch lever 12 and the toggle lever 18 with one end pressed over the toggle 18 and the other end pressed into the opening 42.

As thus constructed, angular movement of the lever 12 up or down will effect actuation of the toggle switch 18.

The imitation wall switch as thus described can be inexpensively manufactured of plastics, easily mounted without altering the existing electrical connections or requiring removal of its component parts and serves, as previously explained, not only as a novelty item in playrooms, children's rooms and the like, but also serves, in a practical way, as a means for assisting older persons or any person for that matter with poor eyesight in a dimly lighted room to easily locate the switch.

It should be understood that the present disclosure is for the purpose of illustration only and includes all modifications or improvements which fall within the scope of the appended claims.

I claim:

1. An imitation wall switch of large size for use in conjunction with a conventional wall switch of the kind wherein there is a wall plate through which projects one end of a toggle lever, comprising an imitation wall plate containing a centrally-located opening, an imitation switch lever, means mounting the imitation switch lever in the opening with one end projecting from the face of the imitation wallplate and the other end projecting from the back of the imitation wallplate, said means comprising accurate bearings on the imitation switch lever, arranged with their convex sides facing the inner side of the imitation wallplate, a bearing plate mounted on the imitation switch lever between the bearings and the imitation wallplate, a means operably connecting the inwardly projecting end of the imitation switch lever to the outwardly projecting end of the toggle lever, comprising a length of elasticly flexible tubing, one end of which is pressed onto one end of the toggle lever, and the other end of which is received in an opening in the end of the imitation switch lever, said elasticly flexible length of tubing operating to hold the bearings rockably pressed against the bearing plate.

2. An imitation wall switch according to claim 1 wherein there is means for securing the imitation wall plate to the existing wall plate, said last mentioned means comprising an adapter plate adapted to be screwed together with the existing wall plate to the switch receptacle.

3. An imitation wall switch according to claim 2 wherein the adapter plate contains an opening through which one end of the toggle switch protrudes.

4. An imitation wall switch according to claim 2 wherein the imitation wall plate has peripherally thereof a continuous flange which is perpendicular to the plane of the plate and defines with the plate an enclosure which conceals the existing wall plate, adapter plate, inwardly-projecting end of the imitation switch lever and the coupling.

5. An imitation wall switch, according to claim 2, wherein the adapter plate contains two pairs of openings; a first pair for receiving the screws by means of which the adapter plate is mounted to the wallplate; and a second pair for receiving screws by means of which the imitatin wallplate is mounted to the adapter plate.

6. An imitation wallswitch, the kind of claim 5, wherein the holes of the first pair of holes are spaced to be in alignment with the holes in the wallplate, so that the same screws that are used to fasten the wallplate are used to mount the adapter to the wallplate.

* * * * *